US009511835B2

(12) United States Patent
Widnall et al.

(10) Patent No.: US 9,511,835 B2
(45) Date of Patent: Dec. 6, 2016

(54) WINGSAIL WITH ADAPTABLE FLEXIBLE FLAP

(71) Applicant: Massachusetts Institute of Technology, Cambridge, MA (US)

(72) Inventors: Sheila E. Widnall, Lexington, MA (US); Peter Joseph Williams, Boston, MA (US); Hayden K. Cornwell, Newport Beach, CA (US)

(73) Assignee: Massachusetts Institute of Technology, Cambridge, MA (US)

( * ) Notice: Subject to any disclaimer, the term of this patent is extended or adjusted under 35 U.S.C. 154(b) by 0 days.

(21) Appl. No.: 14/796,109

(22) Filed: Jul. 10, 2015

(65) Prior Publication Data

US 2016/0083063 A1 Mar. 24, 2016

Related U.S. Application Data

(60) Provisional application No. 62/053,887, filed on Sep. 23, 2014.

(51) Int. Cl.
*B63H 9/04* (2006.01)
*B63H 9/06* (2006.01)

(52) U.S. Cl.
CPC ..... *B63H 9/0607* (2013.01); *B63H 2009/0621* (2013.01)

(58) Field of Classification Search
CPC ..... B63H 8/0607; B63H 9/0607
See application file for complete search history.

(56) References Cited

U.S. PATENT DOCUMENTS 4,369,724 A * 1/1983 Weiss ..... B63H 9/0607 114/102.22
4,402,277 A * 9/1983 Wainwright ..... B63H 9/0607 114/102.22
4,537,146 A 8/1985 Wainwright
4,582,013 A 4/1986 Holland, Jr.
4,856,449 A * 8/1989 Walker ..... B63H 9/0607 114/102.22
4,982,679 A 1/1991 Walker
5,577,752 A * 11/1996 Johnson ..... B60D 1/30 280/432

OTHER PUBLICATIONS

Jones, R.T., "The Spanwise Distribution of Lift for Minimum Induced Drag of Wings Having a Given lift and a Given Bending Moment". NACA Technical Note 2249, 1950.
Woo, C.J. et al. "Towards an optimum yacht sail." Journal of Fluid Dynamics. 1978, pp. 459-477. vol. 85, Part 3. Great Britian.
Junge et al. "Optimizing Spanwise Lift Distributions Yacht Sails Using Extended Lifting Line Analysis." Journal of Aircraft. Nov.-Dec. 2010. vol. 47(6).
Sneyd et al. "The influence of a yacht's heeling stability on optimum sail design." Fluid Dynamics Research. 1997. pp. 47-63. vol. 19. Elsevier.

(Continued)

*Primary Examiner* — Stephen Avila
(74) *Attorney, Agent, or Firm* — Sam Pasternack; MIT Technology Licensing Office

(57) ABSTRACT

Wingsail. The wingsail includes a substantially rigid airfoil section having a leading and a trailing edge and a flap is attached to the trailing edge through a torsion fitting having a torsional stiffness along the span of the rigid airfoil section selected to control flap deflection with respect to the rigid airfoil section under aerodynamic loading to control rolling moment of the wingsail.

6 Claims, 13 Drawing Sheets

(56) References Cited

OTHER PUBLICATIONS

Harmon, R. L. "Aerodynamic Modeling of a Flapping Membrane Wing Using Motion Tracking Experiments." 2009, ProQuest LLC. Ann Arbor, MI.
Fisher, A. "The Boat That Could Sink the America's Cup." Wired. May 9, 2013. http://www.wired.com/2013/05/americas-cup-boat-crash/.
Fisher, A. "What Went Wrong in the Deadly America's Cup Crash." Wired. May 9, 2013. http://www.wired.com/2013/05/americas-cup-crash/.
Griffin, J "Wing sail design." America's Cup Experience. Mar. 22, 2013, http://www.cupexperience.com/americas-cup-ac72-design-wing-sail/.
"Notification of Transmittal of the International Search Report and the Written Opinion of the International Searching Authority, or the Declaration" for PCT/US2015/047912, mailed Dec. 8, 2015.

* cited by examiner

Torsional Moment M(y) at y
due to Aerodynamic Moment m(y)

$\alpha + \alpha_1(y)$ Distribution: chord = 1.5: Y=4; $\kappa$ =1

Spanwise Lift Distribution; Constant Chord

Spanwise Lift/Lift$_{Rigid}$ Distribution; Constant Chord

Spanwise Moment Distribution; Constant Chord

Total Lift and Moment Relative to Rigid Wing vs. U-fps: Constant chord: $c_0$=1.5; Y=4; $\kappa$=1

α + α1(y) Distribution: Y=4; κ =1

α + α1(y) Distribution: Y=4; κ =1;
Comparision with Constant Chord

Spanwise Lift Distribution

Spanwise Lift/Lift$_{Rigid}$ Distribution; Comparison with Constant Chord

Lift/Lift$_{Rigid}$ and Moment/Moment$_{Rigid}$ vs. U fps
Comparison with Constant Chord Lift/Lift$_{20}$ vs. U above U$_{crk}$ at
Constant Rolling Moment Spanwise Chord and Torsional Stiffness Distribution A(y) and B(y) for varying Torsional Stiffness α + $\alpha_1$(y) vs. y for Different Wind Speeds;
Nonuniform Stiffness
Comparison with Constant Chord Solution.

Spanwise Lift Distribution at Different Wind Speeds; Nonuniform Stiffness Comparison with Constant Chord Solution.

Spanwise Contibution to Rolling Moment

Spanwise Contribution to Rolling Moment; Comparison to Constant Chord Solution

Total Lift and Moment Relative to Rigid Wing vs. U-fps: Varying Stiffness; Comparison to Constant chord Total Lift and Moment Relative to RigidWing vs. U-fps: Varying Stiffness; Comparison to Constant Stiffness; Comparison to Constant chord Spanwise Distribution of Angle of Attack in Degrees as a Function of Non-Dimensional Velocity Spanwise Distribution of Lift Coefficient as a Function of Non-Dimensional Velocity Spanwise Distribution of Moment Coefficient as a Function of Non-Dimensional Velocity

WINGSAIL WITH ADAPTABLE FLEXIBLE FLAP

This application claims priority to provisional application No. 62/053,887 filed on Sep. 23, 2014, the contents of which is incorporated herein by reference.

BACKGROUND OF THE INVENTION

This invention relates to a wingsail and more particularly to a wingsail with a flexible flap that responds to air flow so as to reduce rolling moment of the wingsail.

In yacht racing the geometry of the wind direction and the angle of attack of the sails is such that aerodynamic lift on the wing is resolved into forward thrust on the yacht. The wind flow also establishes a rolling moment that can cause capsizing. It is particularly important to avoid increases in rolling moment at high wind speed to avoid dangerous capsizing.

Several researchers have considered the optimization of spanwise loading on a wing, subject to different constraints. Jones (1) calculated the optimum spanwise lift distribution for a wing subject to a constraint on lift and root bending moment. Tan and Wood (2) applied these ideas to determine the optimum spanwise lift distribution for a yacht sail subject to a constraint on the rolling moment while maximizing forward thrust. Subsequent researchers, such as Junge et al. (3) and Sneyd and Sugimoto (4) extended the analysis to include spanwise variation of wind strength and direction and boat heel. All of these analyses confirm the importance of maximizing lift and/or forward thrust while constraining rolling moment. In the analysis of a yacht, the geometry of the wind direction relative to the yacht direction is such that aerodynamic lift on the wing provides a component of forward thrust on the yacht. Thus we will occasionally use the terms lift and thrust interchangeably.

These prior art analyses focused on the design of a wing or a fixed sail planform optimized to operate at a given wind speed. As sailing has moved to the use of wingsails, the analysis of the sail overlaps with traditional aerodynamics. However, unlike an aircraft wing which is designed to operate at a gives flight speed, and is equipped with devices such as flaps for lower landing speeds, a racing yacht operates over a wide range of wind speeds. Typical values would range from 10-30 knots, at which point the race would be called off.

The present invention is a wingsail with a substantially rigid airfoil section having a leading and a trailing edge. A flap is attached to the trailing edge through a torsion fitting having a torsional stiffness along the span of the rigid airfoil section selected to control flap motion with respect to the rigid airfoil section under aerodynamic loading to control rolling moment of the wingsail. In preferred embodiments, the torsional stiffness is constant along the span or the torsional stiffness varies along the span. The flap may be segmented or unitary or both. The rigid airfoil section and the flap may have a constant chord along the span or a varying chord along the span.

It is therefore an object of the invention to provide a wingsail having a flap portion to control rolling moment of the wingsail.

DESCRIPTION OF THE PREFERRED EMBODIMENT

Figure 1:
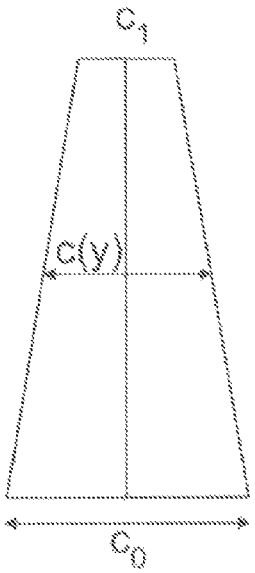
FIG. 1 is a plan view of a wing of span Y and chord due to c(y).

In this patent application, we disclose the use of spanwise deformable wings to allow a wingsail to operate in an optimum and naturally occurring adaptive manner over a wider range of wind speeds while still constraining rolling moment.

Large catamarans, as are used in the America's Cup, have large wingsails with a high aspect ratio. These wings are very effective and can generate significant thrust. However, these wingsails are not always trimmed to give optimum performance, and due to the large span of the wind can create extreme rolling moments. In soft sails, the sail can be trimmed in order to depower the sail, and can be reefed-reducing the span—at high wind velocities. In the wingsail case, this rolling moment can be reduced by having multiple vertical flap sections that can be individually controlled by the crew to give a desired span-wise twist, as described in ref (8). Altering these sections already leads to a decrease in performance, but the fact that these are manually controlled by the crew means that the sail is not trimmed at its optimized potential. Also, given that the crew has other responsibilities, there are more chances for the boat to capsize in an emergency. When boats capsize, especially boats used in the America's Cup, it is highly dangerous for the crew and can lead to substantial financial loss.

By creating a wingsail with a naturally deformable span-wise-twisting trailing flap, we can potentially decrease this rolling moment at high wind speeds in a naturally occurring, adaptive manner without a substantial penalty in lift and drag. Adaptive wingsails also have an advantage in their dynamic response to sudden changes in wind speed, or gusts. The spanwise flexibility will adaptively reduce the lift on the wing during a sudden increase in wind strength. This reduction in lift will be most pronounced at the wing tip, providing a limitation on the rolling moment.

In our analysis, we consider the behavior of a wingsail consisting of a forward wing section with a flap attached to its trailing edge through a torsion fitting. The individual airfoil sections of the flap are taken to be rigid in cross section but deformable in twist in the spanwise direction. The total resistance to spanwise twist deformation in response to applied aerodynamic moments is characterized by the torsional stiffness, whether this comes from a structural attachment that functions as a torsion rod and/or from the stiffness of the airfoil sections to spanwise twist.

We first consider a sing of constant chord, which can be solved analytically, then a wing of varying chord with constant torsional stiffness; and finally a wing of varying chord with varying apply these ideas to a wingsail of any size operating in a specified range of wind speeds.

This analysis also has application to the use of wingsails to power cargo ships. Automatic reduction of rolling moment at high wind speeds due to spanwise flexibility would be especially important for a ship that operates on the open ocean, reducing the work load on the crew while maintaining good safety margins. The analysis is also applicable to extreme sailing competitions, such as round-the-world races, which can encounter extremely dangerous conditions off-shore.

We consider a wing of span Y and chord c(y) as shown in FIG. 1. The wing consists of a rigid airfoil section with a flap attached to the fixed airfoil by a torsion rod of strength κ. The chord of the wing is c(y); for our calculations, we will consider a flap chord that is one-half of the local wing chord $c_F(y)=\frac{1}{2}c(y)$. Initially, we will take the torsional stiffness κ to be constant along the span but clearly its variation could be easily included, as is done in the final case studied.

Figure 2:
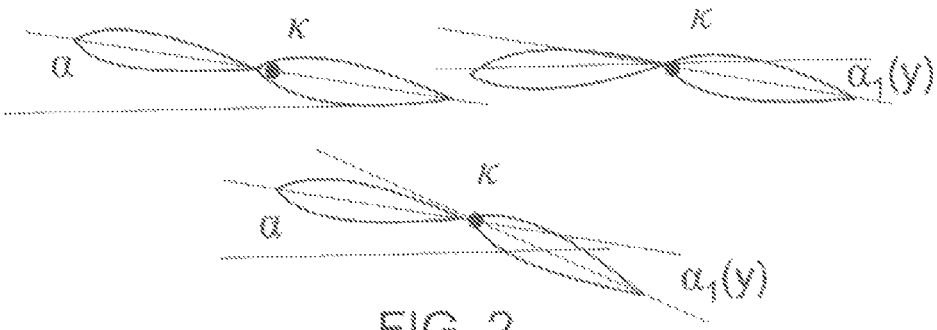
FIG. 2 is a cross-sectional view of a wing/flap combination.

The angle of attack of the wing is taken as α; the angle of attack of the flap relative to the wing is $\alpha_1(y)$ as shown in FIG. 2. Since our interest is in the effect of spanwise flexibility, $\alpha_1$ is a function of y, determined by aerodynamic loads and torsional stiffness.

We will use two-dimensional linear aerodynamic theory and treat each spanwise section using "strip" theory to estimate the effects of spanwise flexibility on the lift and moment distribution along the span. That is, the airfoil flow is assumed to be locally two-dimensional, and the local lift and moment are integrated along the span to obtain the total results for lift and rolling moment.

At each section, the aerodynamic moment about the attachment point depends upon both α and $\alpha_1(y)$.

$$m(y)=\tfrac{1}{2}\rho U^2 c(y)^2(C_{m_0}\alpha+C_{m_1}\alpha_1(y)) \tag{1}$$

where $C_{m_0}$ and $C_{m_1}$, the local moment slope coefficients, are available from linear two-dimensional theory. They depend upon the magnitude of the flap chord $c_F(y)$ relative to the total airfoil chord c(y). The moment on the flap acts to reduce the flap deflection $\alpha_1$.

Figure 3:
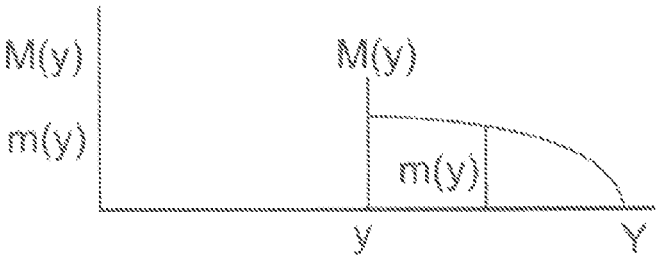
FIG. 3 is a graph of torsional moment due to an aerodynamic moment.

The relation between the aerodynamic moments and the local angle of attack is given by the torsional stiffness equation.

$$\kappa\frac{d\alpha_1}{dy} = M(y) = \int_y^Y m(y)\,dy \tag{2}$$

where κ is the torsional stiffness: torque (in ft lbs) per radians/ft of twist:

$$K = M \Big/ \frac{d\alpha_1}{dy};\ K$$

is a local material property of the structure. M(y) is the total moment at y due to the aerodynamic moment distribution along the span. See, FIG. 3.

Since the total torsional moment M(y) goes to zero at the tip, the total torsional moment acting at the point y is the integral of the aerodynamic moment m(y) from y to the tip y=Y. The governing equation for the unknown flap deflection angle $\alpha_1$ is given by the derivative of equation (2).

$$\frac{d^2\alpha_1}{dy^2} = m(y) = \frac{\rho U^2 c(y)^2}{2\kappa(y)}(C_{m_0}\alpha + C_{m_1}\alpha_1(y)) \tag{3}$$

This is a linear non-homogenous second order equation for $\alpha_1(y)$ The boundary conditions for the equation are $\alpha_1(0)=\alpha_{1_0}$ and $$\frac{d\alpha_1(Y)}{dy} = 0.$$

That is, the initial flap deflection $\alpha_{1_0}$, is set at the root of the wing; and since there is no moment M(y) at the tip, y=Y, the slope $$\frac{d\alpha_1}{dy}$$

is zero at the tip y=Y.

The governing equation is easily solved if both the chord c(y) is a constant: $c(y)=c_0$, and the torsional stiffness κ(y) is a constant, κ(y)=κ. We begin with this case. We also take the chord of the flap equal to half of the chord of the total airfoil: $c_F=c/2$. The span Y is taken as 4. For this choice, we can easily obtain the various lift and moment distributions along the wing. We will do this subsequently.

The governing equation is characterized by the ratio of the dynamic pressure times the chord $c_0^2$ divided by the torsional stiffness κ: written for constant chord and constant torsional stiffness we define $$Q = \frac{\rho U^2 c_0^2}{2\kappa}.$$

This results in the governing equation $$\frac{d^2\alpha_1}{dy^2} - QC_{m_1}\alpha_1 = QC_{m_0}\alpha \tag{4}$$

with boundary conditions $\alpha_1(0)=\alpha_{1_0}$ and $d\alpha_1(Y)/dy=0$. Defining $A=C_{m_0}Q$ and $B=C_{m_0}Q$ we have $$\frac{d^2\alpha_1}{dy^2} - B\alpha_1 = A\alpha \tag{5}$$

The solution is $$\alpha_1(y) = \frac{\left(e^{\sqrt{B}\,y}\left(A\alpha t - 1 - e^{\sqrt{B}\,y}\right)\right) * \left(e^{\sqrt{B}\,y} - e^{2\sqrt{B}\,Y}\right) + \alpha_{1o}B * \left(0^{2\sqrt{B}\,y} + e^{2\sqrt{B}\,Y}\right)}{B\left(1 + e^{2\sqrt{B}\,Y}\right)} \tag{6}$$

From linear theory for this case, we obtain the aerodynamic moments about the flap attachment point due to the deflection of the forward airfoil a and the deflection of the flap $\alpha_1(y)$, for an airfoil with a flap chord equal to half of the airfoil chord. These moment coefficients are: $C_{m_0}\alpha=0.212\alpha$ and $C_{m_1}\alpha_1(y)=0.265\alpha_1(y)$. For later use, we also obtain the lift coefficients for the airfoil as $C_{L_0}=2\pi\alpha$ and $C_{L_1}=5.181\alpha_1(y)$. We take the torsional stiffness κ equal to 1.

Figure 4:
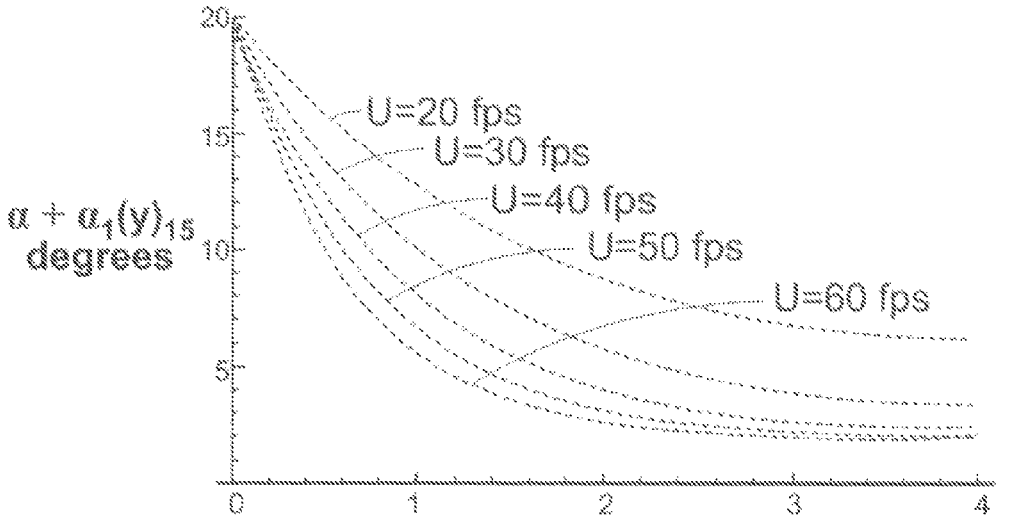
FIG. 4 is a graph of total angle of attack of the flap relative to the free stream as a function of y.

The results for the total angle of attack of the flap relative to the free stream, $\alpha+\alpha_1(y)$, as a function of y are shown in FIG. 4 for a variety of velocities U in fps. The angles α and $\alpha_1(0)$ are taken as 10° for all wind speeds. The effects of flap spanwise flexibility are clearly seen. At a wind speed of 60 fps, the angle of attack of the flap relative to the free stream flow is dramatically reduced at the tip due to its flexibility.

Figure 5:
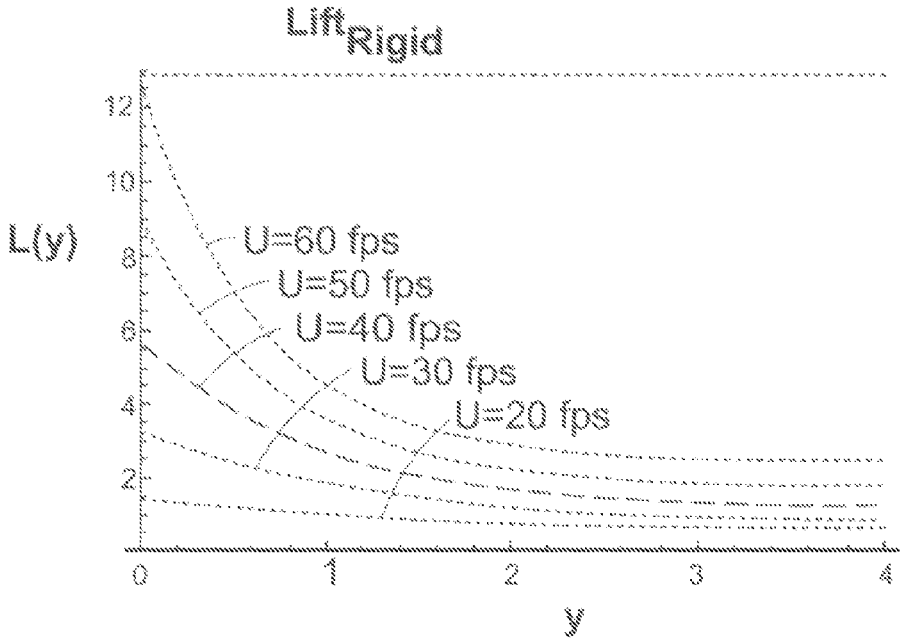
FIG. 5 is a graph of spanwise lift distribution for several wind velocities.

For a wing of constant chord $c_0$, the spanwise lift distribution is obtained directly from the angles of attack α and $\alpha_1(y)$, of the wing and the flap, using "strip" theory. where the lift coefficients $C_{L_0}$ and $C_{L_1}$ have been previously introduced. The spanwise lift distribution is shown in FIG. 5 for wind velocities of 20, 30, 40, 50, and 60 fps for a torsional stiffness κ=1, α=10° and $\alpha_{1_0}$=10°. The spanwise lift distribution for a rigid wing at 60 fps is also shown. The reduction of spanwise lift distribution due to spanwise flexibility is dramatic.

$$L(y)=\tfrac{1}{2}\rho U^2 c_0 C_{L_0}\alpha+\tfrac{1}{2}\rho U^2 c_0 C_{L_1}\alpha_1(y) \tag{7}$$

Figure 6:
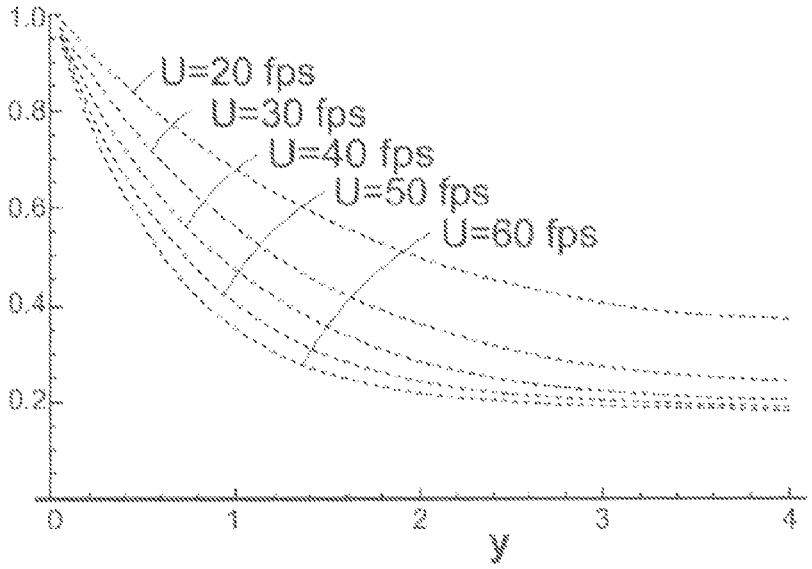
FIG. 6 is a graph of spanwise lift distribution at a given velocity divided by the lift on a rigid wing having the same chord, planform and angle of attack.

FIG. 6 shows the spanwise lift distribution at a given velocity divided by the lift on a rigid wing of the same chord, planform and angle of attack. The effects of spanwise flexibility are clearly evident in the decreased lift outboard of the root relative to that of a rigid wing as the wind velocity increases.

The aerodynamic moment used to characterize the effects of spanwise flap flexibility on wing performance is the moment about the root chord, y=0: the rolling moment. For a wing of constant chord $c_0$, the contribution to the rolling moment from each spanwise section y is given by $$M(y)=\tfrac{1}{2}\rho U^2 c_0(C_{L_0}\alpha+C_{L_1}\alpha_1(y))y \tag{8}$$

Figure 7:
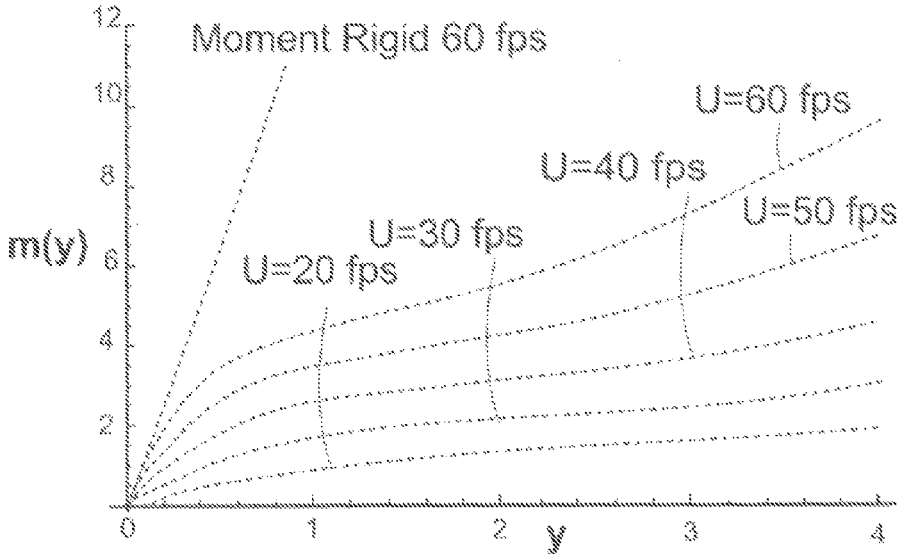
FIG. 7 is a graph showing spanwise moment distribution for a constant chord wing.

For the case examined, the results are shown in FIG. 7 for wind velocities of 20, 30, 40, 50, and 60 fps. Also shown is the contribution to the rolling moment from each spanwise section for a rigid wing. The decrease in sectional moment for the flexible flap is clearly evident.

The total lift and moment on the wing for a wing of constant chord $c_0$ is obtained by integrating the sectional lift and moment along the span.

$$L_T=\tfrac{1}{2}\rho U^2\int_0^Y c_0((C_{L_0}\alpha+C_{L_1}\alpha_1(y)dy \tag{9}$$

$$M_T=\tfrac{1}{2}\rho U^2\int_0^Y c_0((C_{L_0}\alpha+C_{L_1}\alpha_1(y)ydy \tag{10}$$

Figure 8:
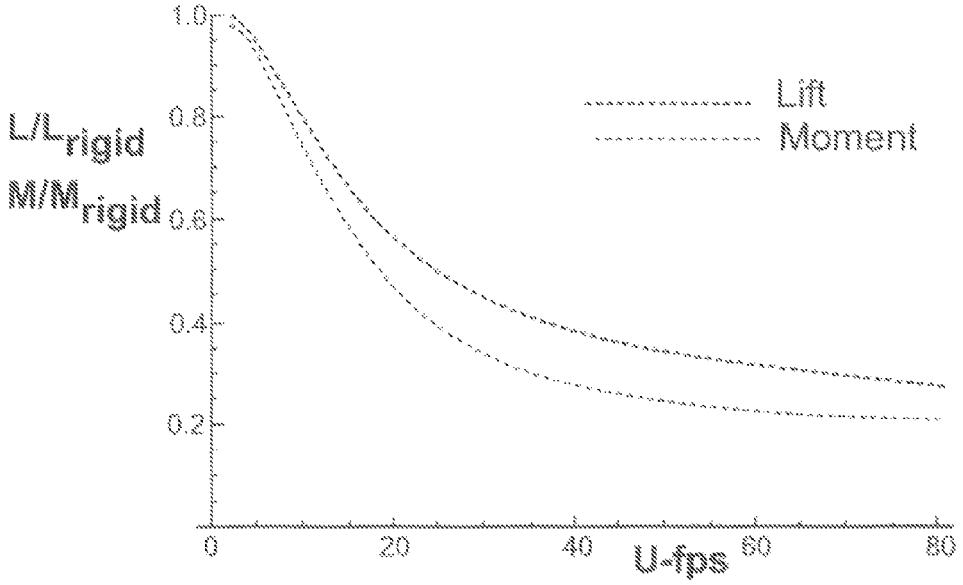
FIG. 8 is a graph showing the ratio of lift and moment to that of a rigid wing of the same planform.

Of interest is the ratio of the total lift and total moment on the flexible wing referred to the total lift and moment on a rigid wing of the same planform $$L_{T_{Rigid}}=\tfrac{1}{2}\rho U^2\int_0^Y c_0((C_{L_0}\alpha+C_{L_1}\alpha_{1_0})dy \tag{11}$$

$$M_{T_{Rigid}}=\tfrac{1}{2}\rho U^2\int_0^Y c_0((C_{L_0}\alpha+c_{L_1}\alpha_{1_0})ydy \tag{12}$$

where $\alpha_{1_0}$ is the initial angle of attack of the flap at the root; for a rigid wing $\alpha_{1_0}$ remains constant along the span. The ratio of lift and moment to that of a rigid wing of the same planform is shown in FIG. 8 as a function of velocity U. The difference due to spanwise flexibility is clearly seen, as is the more dramatic effect of flexibility on moment than upon lift.

Figure 9:
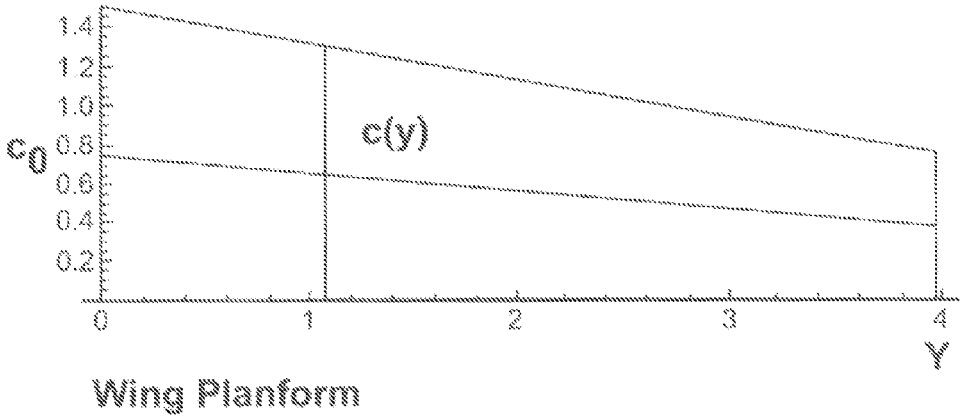
FIG. 9 is a plan view for a general wing shape.

We now consider a wing of non-constant chord. To compare with our earlier analytic solution, we take the root chord as $c_0$=1.5 and the span as Y=4. The chord is taken with a linear variation to a tip chord of $c_1$=75. The chord distribution is then $c(y)=c_0-(c_0-c_1)(y/Y)$. The wing planform is shown in FIG. 9.

We can also take κ to vary along the span, although for our initial calculations we take κ=1.

The governing equation remains $$\frac{d^2\alpha_1}{dy^2} = m(y) = \frac{\rho U^2 c(y)^2}{2\kappa(y)}(C_{m_0}\alpha + C_{m_1}\alpha_1(y)) = A(y)\alpha + B(y)\alpha_1(y) \tag{13}$$

with the inclusion of a chord c(y) that varies with y. The coefficients A(y) and B(y) are as defined in equation (4) and (5), now varying with y:

$$Q(y) = \frac{\rho U^2 c(y)^2}{2\kappa(y)};$$

$A(y)=C_{m_0}Q(y)$; $B(y)=C_{m_1}Q(y)$.

The boundary conditions remain $\alpha_1(0)=\alpha_{1_0}$ and dy=0 at y=Y=4. For this case, κ is again taken as constant: κ=1.

The equation is solved numerically for $\alpha_1(y)$ for different values of U: U=20, 30, 40, 50, and 60 fps. The angle of attack of the wing α is taken as 10°; the initial angle of attack of the flap $\alpha_1(0)$ is also taken as $\alpha_1(0)$=10°.

Figure 10:
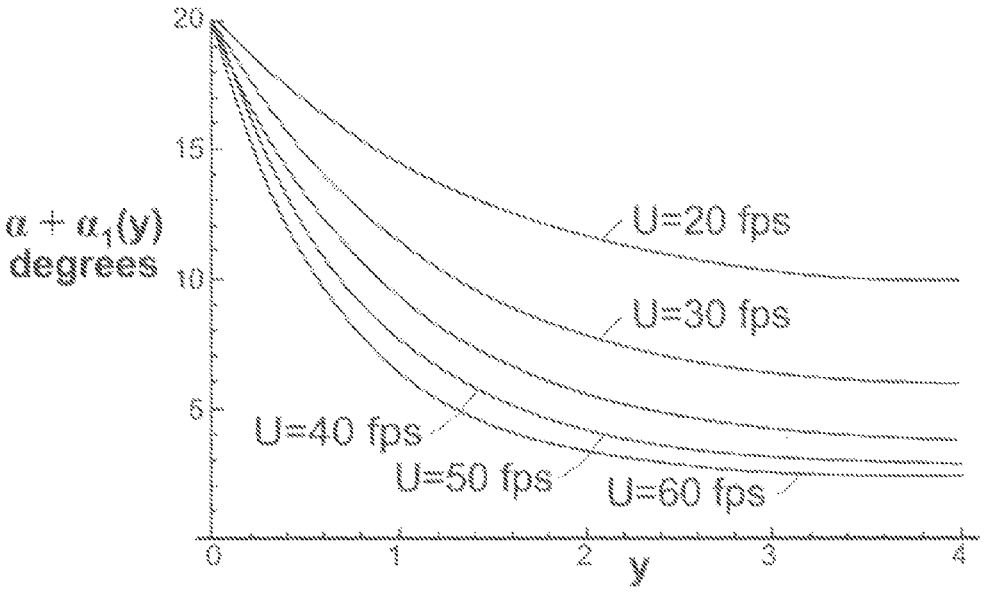
FIG. 10 is a graph showing spanwise variation of total angle of attack as a function of wind speed.

The results show the spanwise variation of the total angle $\alpha+\alpha_1(y)$ as a function of wind speed U in FIG. 10. The decrease in angle of attack towards the tip due to spanwise flexibility at higher wing speeds is evident.

Figure 11:
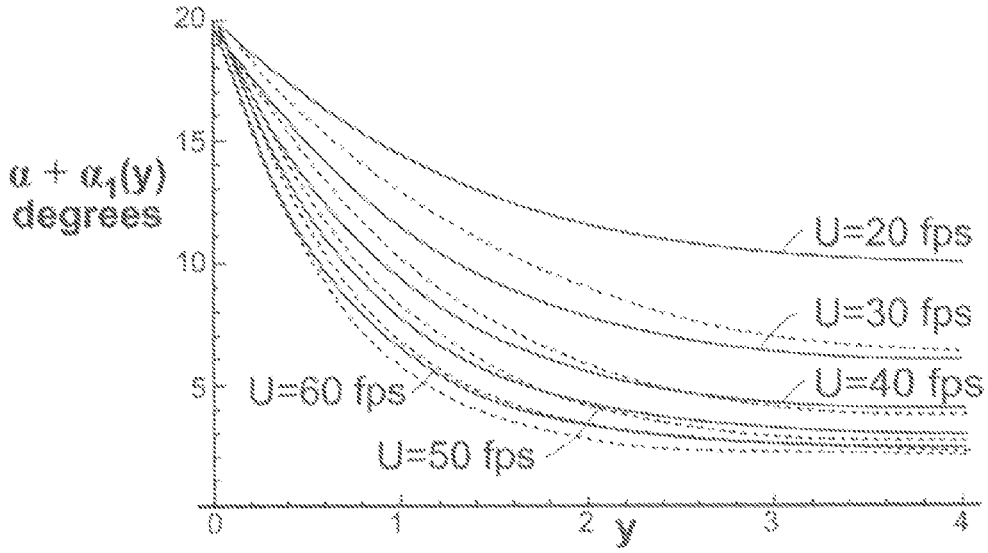
FIG. 11 is a graph of angle of attack for various wind speeds.

Also shown in FIG. 11 is a comparison of the constant chord case (dashed) with the varying chord numerical solution. The constant chord solution for local angle of attack is somewhat more affected by spanwise flexibility at lower wind speeds but the overall results are quite similar.

The spanwise lift and moment distribution is obtained from the strip theory formula using the solution for the flexible spanwise distortion of the flap $\alpha_1(y)$. For this case both $\alpha$ and $\alpha_1(0)$ were taken as 10°.

$$L(y)=\tfrac{1}{2}\rho U^2 c)(y)(C_{L_0}\alpha+C_{L_1}\alpha_1(y) \tag{14}$$

$$M(y)=\tfrac{1}{2}\rho U^2 c)(y)(C_{L_0}\alpha+C_{L_1}\alpha_1(y) \tag{15}$$

Figure 12:
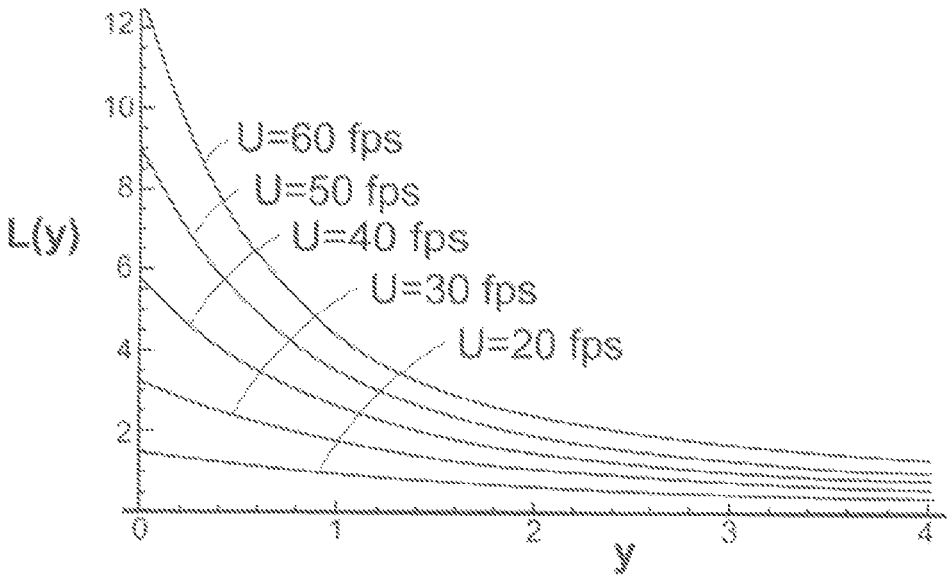
FIG. 12 is a graph of spanwise lift distribution for a variety of wind speeds at constant angle of attack.

FIG. 12 shows the spanwise lift distribution L(y) for a variety of wind speeds at constant angle of attack. The effect of spanwise flexibility at higher wind speeds is evident.

Figure 13:
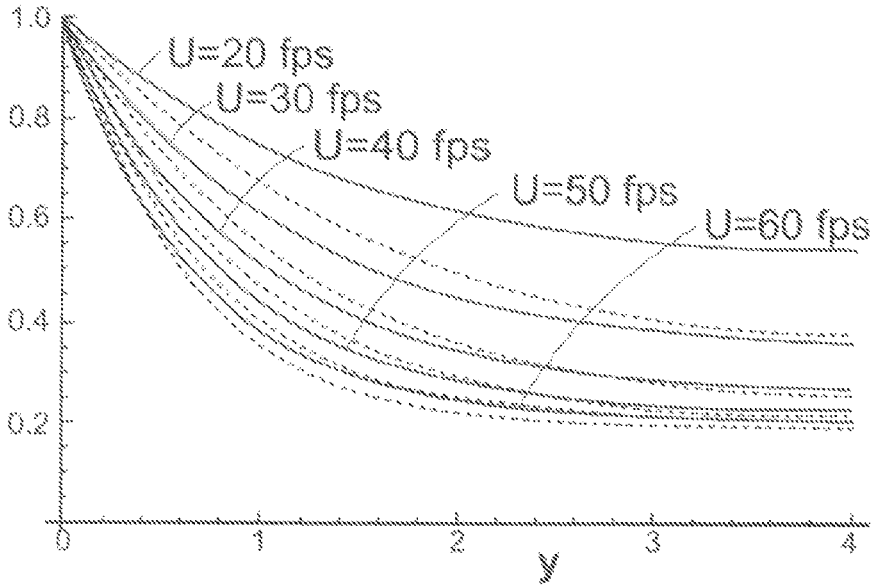
FIG. 13 is a graph showing spanwise lift referenced to the lift of a rigid wing of the same geometry.

FIG. 13 shows the spanwise lift distribution referenced to the lift of a rigid wing of the same geometry. Also shown dashed is the solution for the wing of constant chord at the same root chord and span. The results are quite close especially at higher wind speeds.

Figure 14:
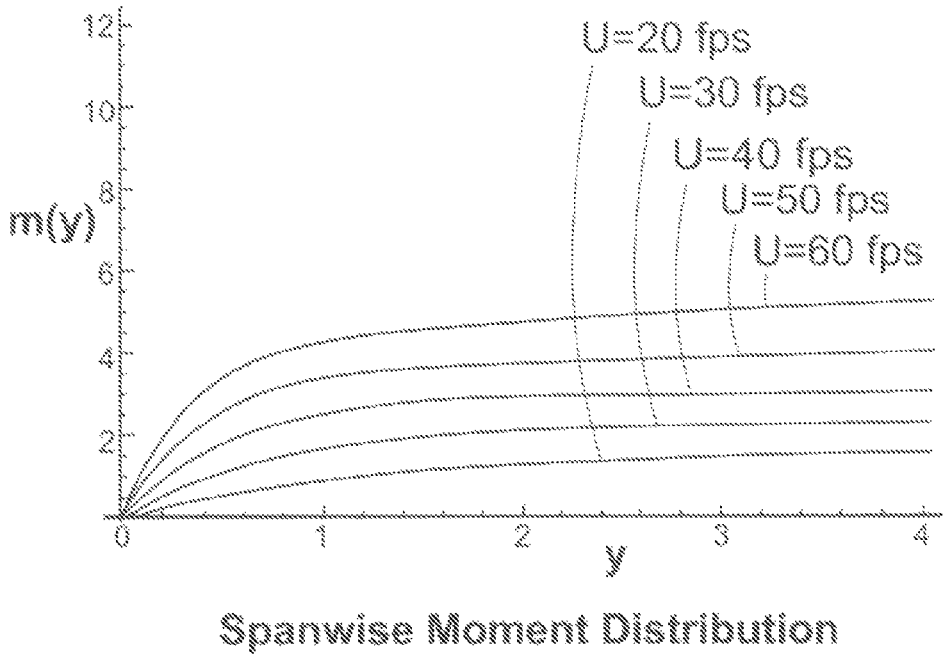
FIG. 14 is a graph showing the contribution to rolling moment from various spanwise sections.

FIG. 14 shows the contribution to the rolling moment from the various spanwise sections. The spanwise flexibility of the flap acts to decrease the contribution from the outboard sections.

Figure 15:
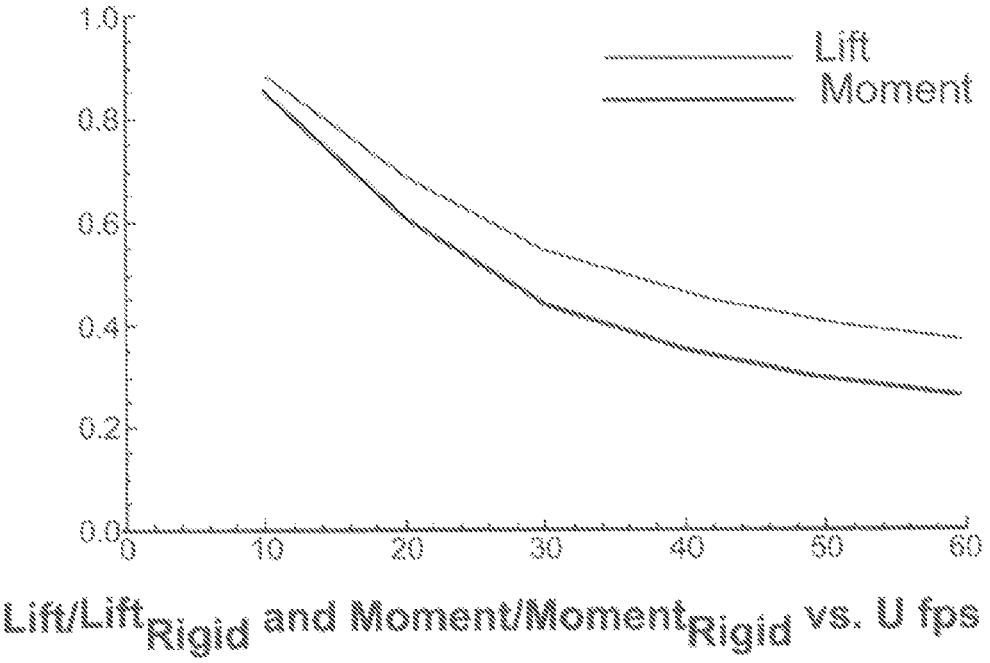
FIG. 15 is a graph showing total lift and rolling moment relative to that of a rigid wing as a function of wind speed.

FIG. 15 shows the total lift and rolling moment as a function of wing speed, referred to their values for rigid wing of the same geometry. As can be seen, spanwise flexibility greatly reduces the lift and rolling moment at higher wind speeds. The reduction is greater for the rolling moment than for the lift.

Figure 16:
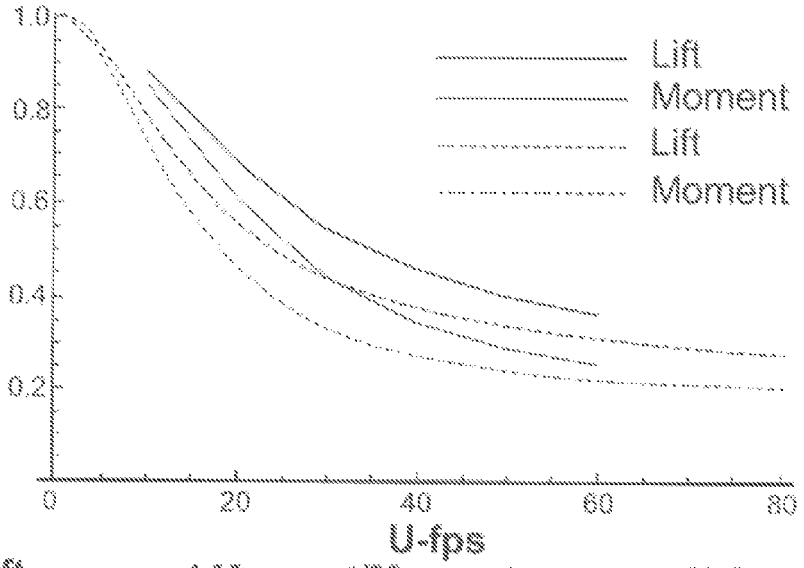
FIG. 16 is a graph showing total lift and rolling moment relative to that of a rigid wing for both a wing of constant chord and a wing of linearly varying chord.

Finally, the results are shown in FIG. 16 for total lift and rolling moment for both the wing of constant chord and the wing of linearly varying chord, for the same value of root chord $c_0$=1.5 and torsional stiffness $\kappa$=1. The results are very similar, giving the designer a tool for designing a wing for a particular application, for example to maintain a reasonable lift while reducing rolling moment at higher wind speeds in comparison to a rigid wing.

In the actual application of these results, the angle of attack would be reduced as the wind speed increases to maintain constraint on rolling moment. Since the governing equations are linear, the lift and moment scale with the actual value of the angle of attack.

Figure 17:
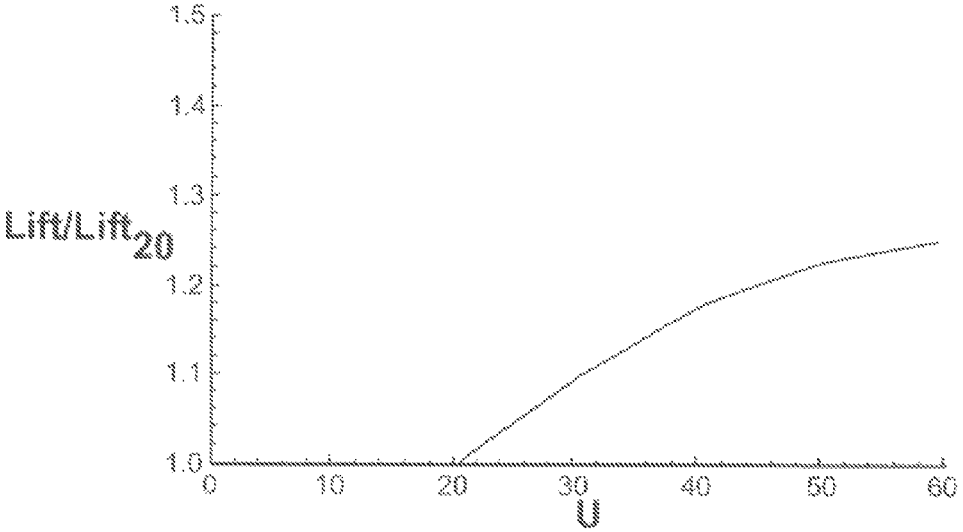
FIG. 17 is a graph of the ratio of lift/lift Ucrit against wind speed with a constrained rolling moment.

As an example, we assume that the constraint on rolling moment is reached at a critical wind speed of 20 fps. We then plot the ratio of lift to its value at 20 fps, using results from this case. As can be seen in FIG. 17, if the rolling moment remains constant due to changes in angle of attack, the lift continues to increase, allowing additional lift/thrust to be generated while maintaining constant rolling moment.

Figure 18:
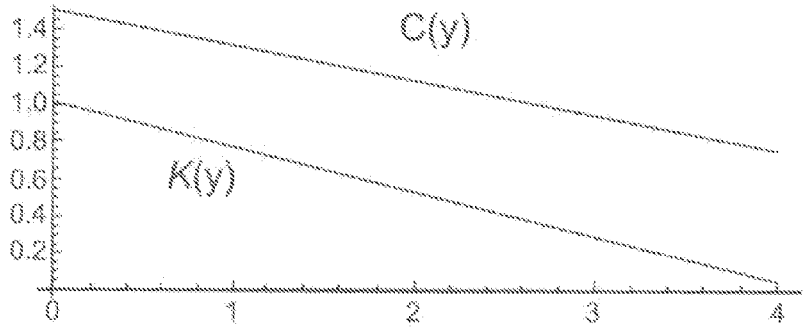
FIG. 18 are graphs of spanwise chord and torsional stiffness distribution.
Figure 18:
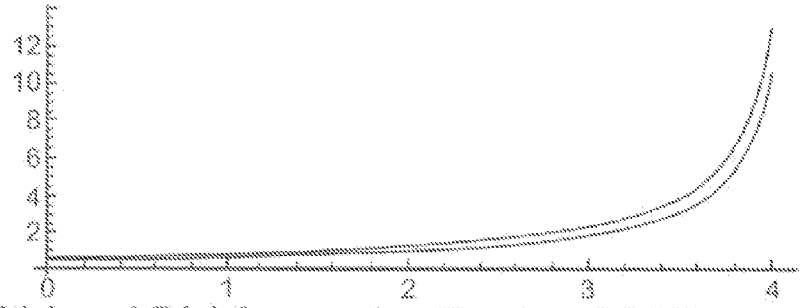

The previous analysis assumed constant torsional stiffness $\kappa$ along the span. Since the loading at the tip is important for the relief of rolling moment at high wind velocities, it makes sense to examine the effect of varying torsional stiffness $\kappa(y)$ along the span. We assume a linear distribution of $\kappa(y)$ as shown in the FIG. 18, with $\kappa(0)$=1; the chordwise variation of chord c(y) along the span is also shown. We allow the torsional stiffness to decrease dramatically with spanwise distance but do not set it to zero at the tip to avoid a singularity in the governing equations. The variation of the coefficients A(y) and B(y) which appear in the governing equations is also shown. Strong variation at the tip is observed.

Figure 19:
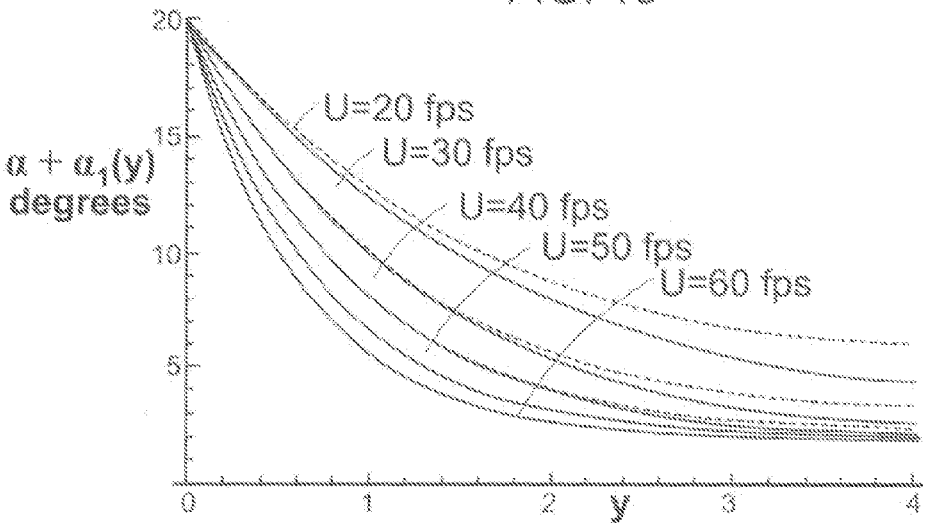
FIG. 19 is a graph comparing variation of angle of attack along the span at various wind speeds in comparison with a constant chord, constant torsional stiffness solution.

For this case, the variation of $\alpha+\alpha_1(y)$ along the span at various wind speeds is shown in FIG. 19 in comparison with the constant chord, constant torsional stiffness solution. As is expected, there is more variation at the wing tip due to the increased tip flexibility.

Figure 20:
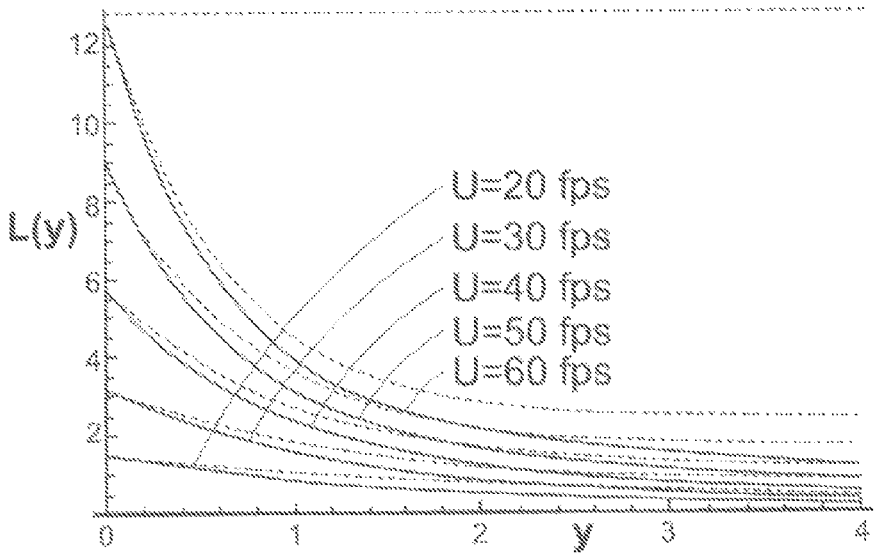
FIG. 20 shows spanwise lift distribution at a constant angle of attack.

Shown in FIG. 20 is the spanwise lift distribution at constant angle of attack in comparison with the constant chord, constant torsional stiffness solution. As expected, the lift is reduced at the wing tip at higher wind speeds.

Figure 21:
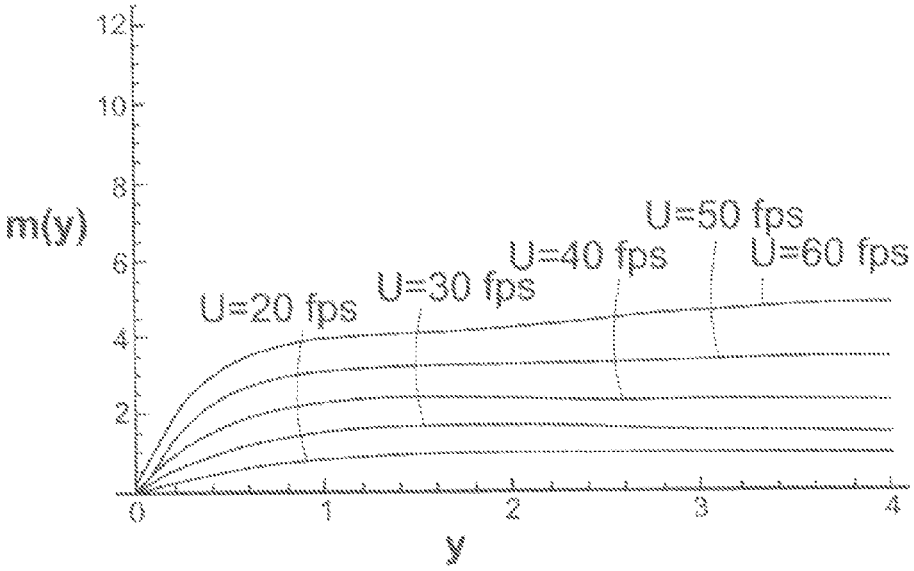
FIG. 21 shows the span wise distribution of moment at constant angle of attack for various wind speeds.

The spanwise distribution of moment at constant angle of attack is shown in FIG. 21. The effect of spanwise flexibility acts to reduce the rolling moment contribution well below that for a rood wing.

Figure 22:
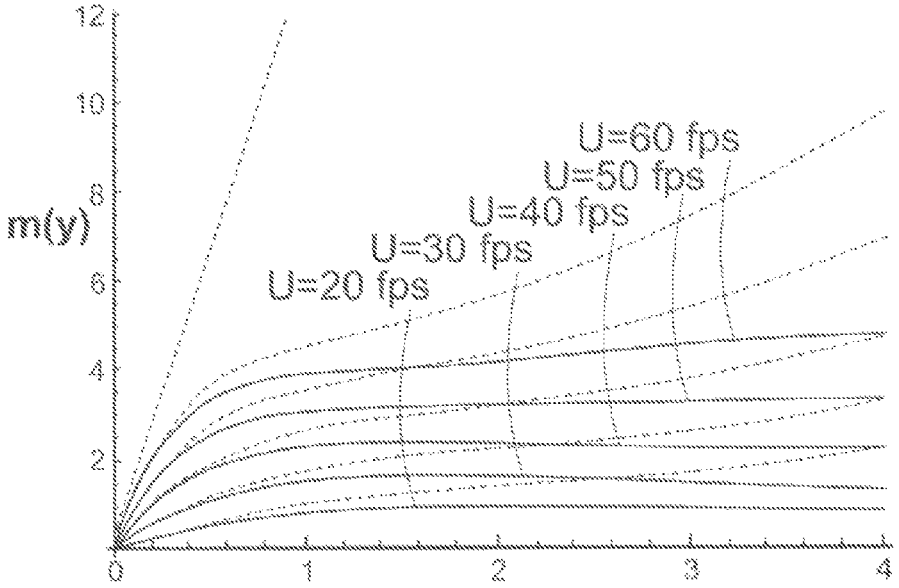
FIG. 22 shows results in comparison to the constant chord, constant stiffness solution.

These results are shown in comparison to the constant chord, constant stiffness solution. The decrease in spanwise contribution to the total rolling moment is evident as shown in FIG. 22.

Figure 23:
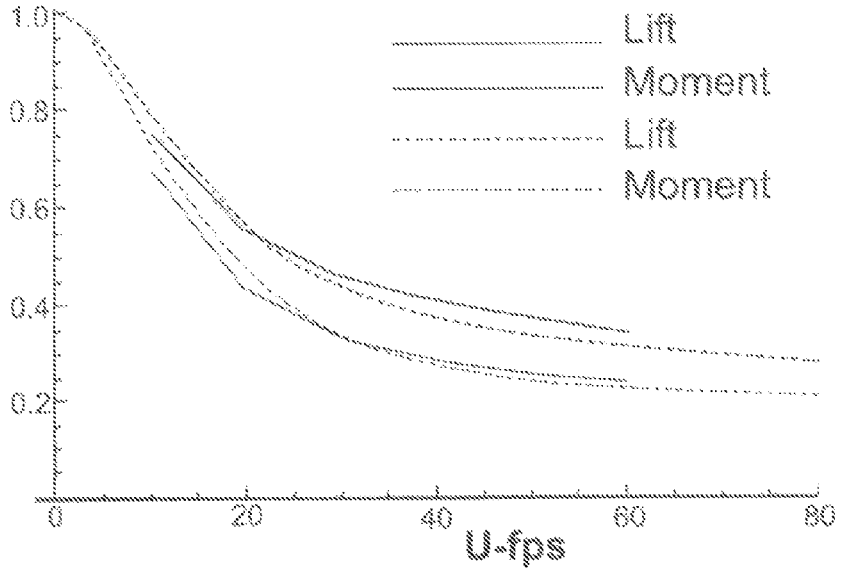
FIG. 23 shows lift and rolling moment relative to their values from a rigid wing as a function of wind speed.

FIG. 23 shows the lift and rolling moment relative to their values from a rigid wing as a function of wind speed. Shown is the solution for varying chord and varying torsional stiffness, as well as the solution for constant chord.

Figure 24:
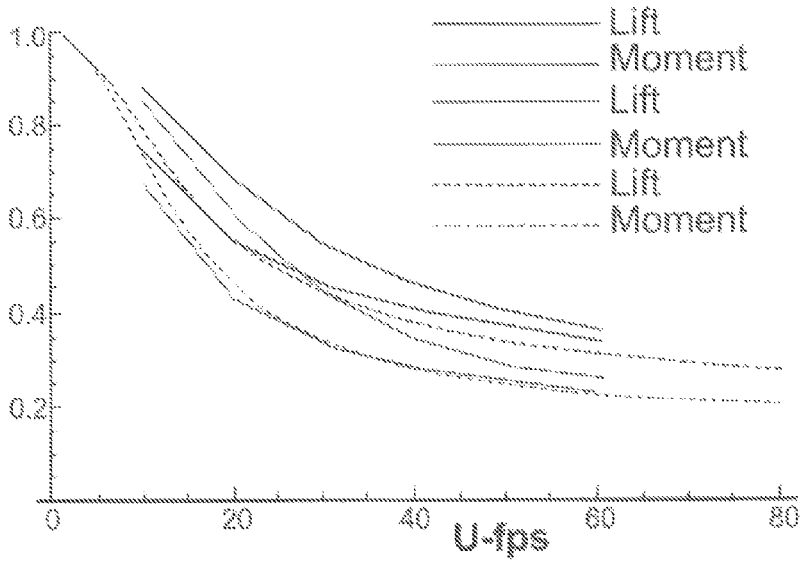
FIG. 24 compares the results of total lift and rolling moment relative to that for a rigid wing for three cases studied as a function of wind speed.

FIG. 24 compares the results of total lift and rolling moment, relative to that for a rigid wing, for the three cases studied as a function of wind speed. These results give the designer choices to achieve a desired outcome.

The previous analysis was conducted for a wing of a speckle size, as would be appropriate to predict the outcome of a wind tunnel test. It is straightforward to extend the analysis, using non-dimensional variables, so that the results are applicable to a wing of any size. The requirements on the wing would specify chord $c_0$, span Y, operating wind speed U and desired behavior. The parameter to be identified for application to a specific wing is the torsional stiffness $\kappa$: torque M required in ft lbs per to produce a twist $d\alpha/dy$, in radians/ft.

We consider the case of constant chord $c_0$ for analytic simplicity; the more general case can easily be considered. We begin our analysis with equation (3).

$$\frac{d^2\alpha_1}{dy^2}=m(y)=\frac{\rho U^2 c_0^2}{2\kappa}(C_{m_0}\alpha+C_{m_1}\alpha_1(y)) \tag{16}$$

This equation is written for a wing span from y=0 to y=Y where Y is the wing span. We nondimensionalize the equation using the variable y'=y/Y. The equation becomes $$\frac{d^2\alpha_1}{dy^2}=m(y)=\frac{\rho U^2 c_0^2 Y^2}{2\kappa}(C_{m_0}\alpha+C_{m_1}\alpha_1(y')) \tag{17}$$

This allows us to identity the governing non-dimensional parameter which we call $\overline{U}$.

$$\overline{U}=\sqrt{\frac{\rho U^2 c_0^2 Y^2}{2\kappa}} \tag{18}$$

We rewrite the equation as $$\frac{d^2\alpha_1}{dy^2}=m(y)=\overline{U}^2(C_{m_0}\alpha+C_{m_1}\alpha_1(y')) \tag{19}$$

The equation now contains one non-dimensional variable $\overline{U}$ and the two moment coefficients that have already been introduced. The solution follows as before.

We construct the solution for the flap angle $\alpha_1(y')$ for constant chord, since this results in a simple analytic solution.

$$\alpha_1(y') = \frac{e^{-\sqrt{C_{m_1}}\,\overline{U}y'}\left(-\alpha C_{m0}\left(e^{2\sqrt{C_{m_1}}\,\overline{U}} - e^{\sqrt{C_{m_1}}\,\overline{U}y'}\right)\left(-1 + e^{\sqrt{C_{m_1}}\,\overline{U}y'}\right) + \alpha_{1o}C_{m_1}\left(e^{2\sqrt{C_{m_1}}\,\overline{U}} + e^{2\sqrt{C_{m_1}}\,\overline{U}y'}\right)\right)}{C_{m_1}\left(1 + e^{2\sqrt{C_{m_1}}\,\overline{U}}\right)} \tag{20}$$

Figure 25:
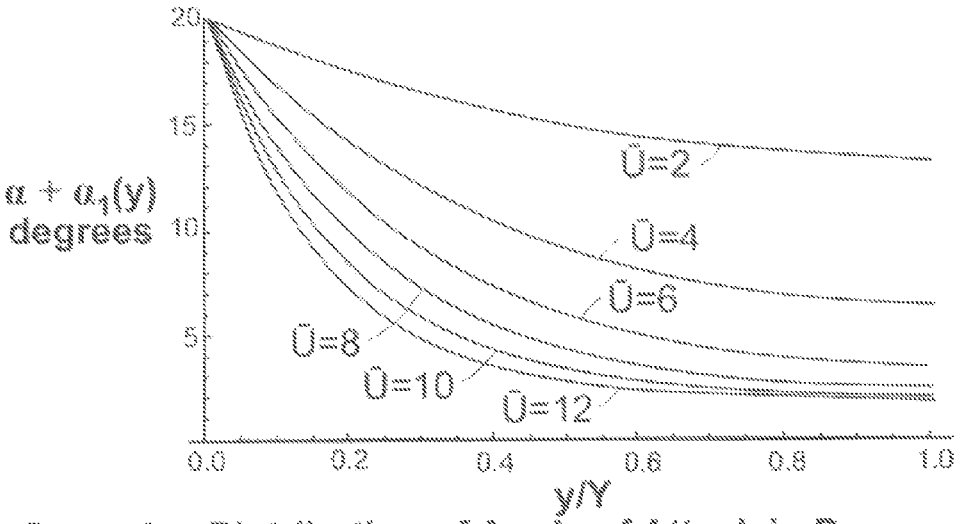
FIG. 25 is a graph showing spanwise distribution of angle of attack as a function of non-dimensional velocity.

This equation determines $\alpha_1(y')$ for various values of the non-dimensional parameter $\overline{U}$. The results for the total angle of attack $\alpha+\alpha_1(y)$ are shown in FIG. 25. The reduction in angle of attack due to spanwise flexibility is quite pronounced in the range $8<\overline{U}$.

Figure 26:
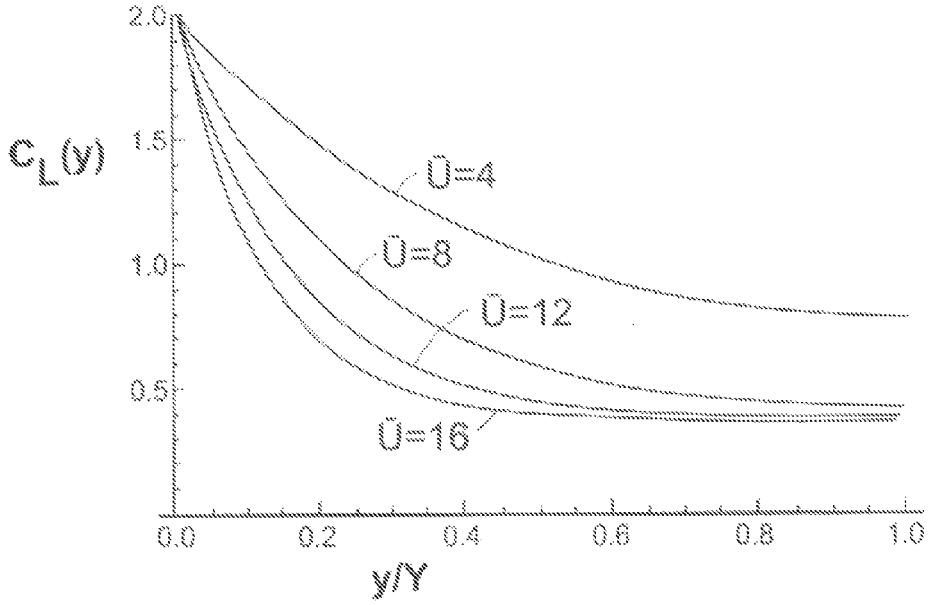
FIG. 26 shows spanwise distribution of lift coefficient as a function of non-dimensional velocity.

The spanwise distribution of lift coefficient $C_L(y')$ is shown in FIG. 26 for a range of $\overline{U}$ from 4 to 16. The range $8<\overline{U}$ shows a dramatic decrease in the contribution of outboard wing sections to the rolling moment coefficient due to spanwise flexibility.

Figure 27:
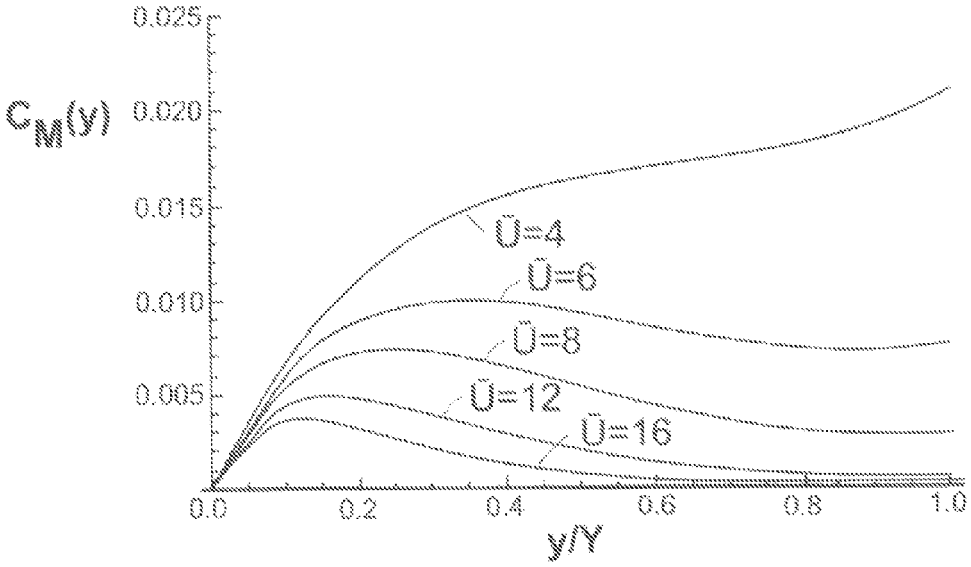
FIG. 27 is a graph showing spanwise distribution of rolling moment coefficient for a range of speeds.

The spanwise distribution of rolling moment coefficient $C_M(y')$ is shown in FIG. 27 for a range of $\overline{U}$ from 4 to 16. The range $8<\overline{U}$ shows a dramatic decrease in the contribution of outboard wing sections to the rolling moment coefficient due to spanwise flexibility.

We now consider how these non-dimensional results relate to our earlier calculations for a specific planform. We consider the constant chord solution: Y=4; $c_0$=1.5; and k=1 and U=40 fps. This results in a $\overline{U}$=8.27. ($\sqrt{\rho(40\text{fps})^2*4^2 1.5^2/(2*(\kappa=1)}=\overline{U}=8.27$.)

We then inquire as so what value of κ would be required to realize this same result (distribution of $\alpha+\alpha_1(y)$) for a wing of span 70 ft., with a chord of 10 ft. at a wind speed of 25 kts. For this case, we set $\sqrt{\rho(25\text{kts}/0.59)^2*70^2*10^2/(2*\kappa)}=\overline{U}=8.27$ and obtain κ=15288. (The factor 0.59 is the conversion from kts to fps.)

Once the spanwise deflection of the flap $\alpha_1(y)$ is determined for a given wind speed, the aerodynamic properties of lift and moment along the span as well as the total lift and total rolling moment can be determined.

As previously noted, at higher wind speeds the angle of attack can be reduced to constrain rolling moment while the lift continues to increase, increasing thrust,

REFERENCES (1) Jones, R. T. "The Spanwise Distribution of Lift for Minimum Induced Drag of Wings Having a Given Lift and a Given Bending Moment" NACA TN2249, 1950

(2) Wood, C. J., Tan, S. H., "Towards an optimum yacht sail." Journal of Fluid Dynamics, Vol. 85, Part 3, 1978, pp. 459-477.

(3) Junge, Timm, Gerhardt, Frederik C., Richards, Peter, Flay, Richard G. J., "Optimization Spanwise Lift Distributions Yacht Sails Using Extended Lifting Line Analysis," Journal of Aircraft, Vol. 47, No. 6, November-December 2010.

(4) Sneyd, A. D., Sugimoto, T., "The influence of a yacht's heeling stability on optimum sail design," Fluid Dynamics Research, Vol. 19, 1997. pp. 47-63.

(5) Harmon, Robyn Lynn, Aerodynamic Modeling of a Flapping Membrane Wing Using Motion Tracking Experiments, ProQuest LLC, Ann Arbor, Mich., 2009

(6) Fisher, Adam, "The Boat That Could Sink the America's Cup," Wired, May 9, 2013. http://www.wired.com/2 cup-boat-crash/. Accessed Mar. 31, 2014.

(7) Fisher, Adam, "What Went Wrong in the Deadly America's Cup Crash," Wired, May 9, 2013, http://www.wired.com/2013/05/americas-cup-crash/. Accessed Apr. 3, 2014.

(8) http://www.cupexperience.com/americas-cup-ac72-design-wing-sail/.

What is claimed is:

1. Wingsail comprising:

a substantially rigid airfoil section having a leading and a trailing edge; and a flap attached to the trailing edge only through a torsion rod fitting providing a substantially linear torque/angular displacement relationship and having a torsional stiffness along the span of the rigid airfoil section selected to control flap motion adaptively with respect to the rigid airfoil section under aerodynamic loading to control rolling moment of the wingsail.

2. The wingsail of claim 1 wherein the torsional stiffness is constant along the span.

3. The wingsail of claim 1 wherein the torsional stiffness varies along the span.

4. The wing of claim 1 wherein the flap is segmented.

5. The wingsail of claim 1 wherein the rigid airfoil section has a constant chord along the span.

6. The wingsail of claim 1 wherein the rigid airfoil section has a varying chord along the span.

* * * * *